US011241071B2

(12) United States Patent
Durif et al.

(10) Patent No.: US 11,241,071 B2
(45) Date of Patent: Feb. 8, 2022

(54) APPLIANCE FOR TREATING THE HAIR

(71) Applicants: L'OREAL, Paris (FR); SEB S.A., Ecully (FR)

(72) Inventors: Pierre Durif, Monsteroux Milieu (FR); Jerome Tougouchi, Villeneuve de Marc (FR); Martial Maisonneuve, Villefontaine (FR); Xavier Vacheron, Genas (FR); Baptiste Bonnemaire, Lyons (FR); Anne Debauge, Saint-ouen (FR); Edouard Messager, Asnieres sur Seine (FR); Gabin Vic, Saint-ouen (FR); Frederic Woodland, Saint-ouen (FR); Stefania Nuzzo, Saint-ouen (FR); Sandy Lapize, Saint-ouen (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 536 days.

(21) Appl. No.: 16/064,213

(22) PCT Filed: Dec. 21, 2016

(86) PCT No.: PCT/EP2016/082175
§ 371 (c)(1),
(2) Date: Jun. 20, 2018

(87) PCT Pub. No.: WO2017/108948
PCT Pub. Date: Jun. 29, 2017

(65) Prior Publication Data

US 2018/0352931 A1 Dec. 13, 2018

(30) Foreign Application Priority Data

Dec. 23, 2015 (FR) ..... 1563205

(51) Int. Cl.
*A45D 2/00* (2006.01)
*A45D 1/04* (2006.01)
(Continued)

(52) U.S. Cl.
CPC ..... *A45D 2/001* (2013.01); *A45D 1/04* (2013.01); *A45D 1/28* (2013.01); *A45D 2001/008* (2013.01)

(58) Field of Classification Search
CPC ... A45D 1/00; A45D 1/04; A45D 1/08; A45D 1/28; A45D 1/20; A45D 1/06; A45D 1/14;
(Continued)

(56) References Cited

U.S. PATENT DOCUMENTS 9,167,877 B2 * 10/2015 Serres-Vives ..... A45D 2/001
2004/0000319 A1 * 1/2004 Carballada ..... A45D 1/04 132/224
(Continued)

FOREIGN PATENT DOCUMENTS

KR 10-2015-0079776 A 7/2015
WO WO 2014/064660 A1 5/2014
WO WO 2015/097628 A1 7/2015

OTHER PUBLICATIONS

Korean Office Action dated Jul. 1, 2019, in Patent Application No. 10-2018-7017696, 9 pages.
(Continued)

*Primary Examiner* — Rachel R Steitz
*Assistant Examiner* — Karim Asqiriba
(74) *Attorney, Agent, or Firm* — Oblon, McClelland, Maier & Neustadt, L.L.P.

(57) ABSTRACT

The appliance for treating the hair, having two arms to be closed over the hair to be treated, at least one of the arms carrying a refill of hair treatment product, the appliance
(Continued)

Figure 1:
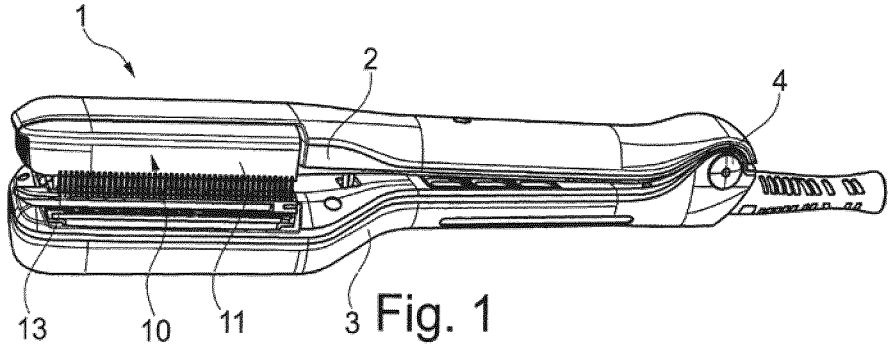

having an electronic control circuit with an electronic memory, this circuit being designed to detect the closure of the arms and the fitting of the refill, the appliance having a steam generator for outputting steam onto the hair and at least one heated straightening plate, the appliance being designed to increment a variable in the memory during the use of the appliance after the refill has been changed and to pass into a downgraded mode of operation in which the operation of the steam generator and/or of the straightening plate is modified when the variable exceeds a first predefined threshold.

10 Claims, 6 Drawing Sheets

(51) Int. Cl.
*A45D 1/28* (2006.01)
*A45D 1/00* (2006.01)

(58) Field of Classification Search
CPC ... A45D 2/00; A45D 6/00; A45D 6/20; A45D 20/00; A45D 20/26; A45D 20/48; A45D 2200/00; A45D 2200/15; A45D 2200/155; A45D 2200/054; A45D 2034/00; A45D 2034/005; A45D 7/02; A45D 2001/008; A45D 19/16
See application file for complete search history.

(56) References Cited

U.S. PATENT DOCUMENTS

| | | | | |
|---|---|---|---|---|
| 2010/0224206 | A1* | 9/2010 | Serresvives | A45D 1/04 132/212 |
| 2011/0253164 | A1* | 10/2011 | Morgandi | A45D 2/40 132/211 |
| 2012/0227758 | A1* | 9/2012 | Ford | A45D 1/04 132/211 |
| 2012/0291797 | A1* | 11/2012 | deGrood | A45D 1/28 132/211 |
| 2012/0312320 | A1* | 12/2012 | Humphreys | A45D 1/28 132/211 |
| 2015/0014461 | A1 | 5/2015 | Cho | |
| 2015/0144610 | A1* | 5/2015 | Cho | A45D 1/28 219/222 |
| 2016/0324290 | A1 | 11/2016 | Fereyre et al. | |

OTHER PUBLICATIONS

International Search Report dated Feb. 16, 2017 in PCT/EP2016/082175 filed Dec. 21, 2016.
French Preliminary Search Report dated Oct. 7, 2017 in French Application 1563205 filed Dec. 23, 2015.

* cited by examiner

APPLIANCE FOR TREATING THE HAIR

The present invention relates to appliances that use a refill to operate and more particularly to appliances for treating the hair such as straightening irons.

The refill contains a product to be applied to the hair, and optionally also an applicator that comes into contact with the region on which the product is intended to be deposited.

The effectiveness of the refill drops as the product contained therein is used up and/or as the latter dries up in the event of prolonged lack of use once fitted on the appliance.

There is a need to signal to the user the need to replace the refill without otherwise excessively hampering the user's use of the appliance.

The invention aims to maintain the effectiveness of the treatment carried out with the aid of the appliance when a refill is present, while hampering the user's use thereof as little as possible on account of the refill being used up.

The application means 13 for applying this product can be a porous substrate impregnated with this product.

It achieves this aim by virtue of an appliance for treating the hair, having two arms to be closed over the hair to be treated, at least one of the arms carrying a refill of hair treatment product, the appliance having an electronic control circuit with an electronic memory, this circuit being designed to detect the closure of the arms and the fitting of the refill, the device having a steam generator for outputting steam onto the hair and least one heated straightening plate, the appliance being designed to increment a variable in the memory during the use of said appliance after the refill has been changed and to pass into a downgraded mode of operation in which the operation of the steam generator and/or of the straightening plate is modified when the variable exceeds a first predefined threshold.

The invention allows the appliance to be used in spite of the lack of refill or in spite of the latter being used up, this use being limited but sufficient to complete a treatment of the hair or to carry out touching-up operations.

Preferably, the appliance is designed to mechanically prevent the fitting of a refill that has previously been used and then removed. Thus, the refill becomes single-use.

Preferably, in order to prevent the reuse of a refill that has already been used, the appliance has a refill accommodating structure having an insertion guide along which the refill travels when it is fitted on the appliance and when it is removed therefrom, and the refill has an element that serves as a use memory. The accommodating structure has a relief that is positioned so as to act on said element when the refill is fitted on the appliance for the first time, so as to cause it to pass from an inactive configuration in which the element is set back from a region of the refill to an active configuration in which this element protrudes into said region. The accommodating structure has a locking member disposed to as to intercept said element when the latter is in the active configuration, while the refill is being fitted in and removed from the accommodating structure. The element and the locking member are designed such that the locking member can be passed over by said element in the direction of removal of the refill and such that the locking member prevents said element from passing in the direction of insertion of the refill, if an attempt is made to reinsert a refill that has already been used.

The above features make it possible to block the fitting of the refill in a simple and effective manner if the latter has previously been used on the appliance.

The abovementioned insertion guide may be designed such that the refill is fitted and removed by way of a sliding movement along the guide. Further movements are likewise possible.

The locking member may be able to move transversely to the direction of travel of said element in contact therewith, the locking member preferably being returned into the initial position by elasticity. It is embodied for example with a spring wire or by a movable part on which a spring acts.

It is possible for the locking member not to be symmetrical with respect to a median plane perpendicular to the direction of travel of said element in contact therewith.

Thus, the locking member may have contact surfaces for contact with said element that have different inlet and outlet slopes, having an inlet slope steeper than an outlet slope, the inlet slope preventing the passage of said element in the active configuration by forming a stop that prevents the travel of said element, and the outlet slope allowing said element to engage with the locking member so as to cause it to retract when said element passes in the direction of removal of the refill. The locking member is passed over in one direction by said element.

The element that serves as a use memory may be embodied in various ways. For example, the element is a pin that is able to move with friction in a corresponding housing in the refill, so as to maintain the active position once it has been brought into the latter.

Said element may be moulded in one piece with a body of the refill, thereby simplifying production.

In this case, the element has for example an active part that cooperates with the locking member in the active configuration and a connecting part that connects said active part to the rest of the refill at least in the inactive configuration. The refill may have a housing and the active part may be designed to be fastened in the housing, notably by snap-fastening, when said element is in the active configuration.

The connecting part is for example a film hinge or a severable bridge of material.

In one variant, the element may also be embodied in the form of a hook articulated on the body of the refill.

The appliance may be designed such that the operation of the steam generator is interrupted in the downgraded mode.

The appliance may also be designed such that the temperature of the straightening plate is modified in the downgraded mode and/or such that the temperature adjustment range of the straightening plate is reduced in the downgraded mode compared with operation in the non-downgraded mode.

The abovementioned variable may be proportional to the number of closures of the arms and may correspond to a fraction of the number of closures of the arms, notably to every fifth one thereof. This can make it possible to reduce the size of the memory and the cost of the electronic circuit.

The variable may incorporate the time for which the arms are closed over the hair, this making it possible to increase precision with regard to estimating the degree to which the refill has been used up.

The appliance may be designed such that the variable is reset when the refill is changed.

The appliance may be designed to pass into the downgraded mode if the variable exceeds a second predefined threshold, different from the first, notably lower than the first, over several uses between which the power supply to the appliance is cut.

Preferably, the appliance has a contactor actuated by the refill fitted on the arm. This contactor is preferably situated upstream of the abovementioned locking member so as to be actuated prior to the locking of the refill during the introduction thereof, in the case of a refill that has already been used. The appliance may have a second actuator which is only actuated once insertion of the refill is complete.

The appliance may have a contactor carried by one of the arms between the head of the arms and the articulation, notably a magnetic contactor of the reed switch type, for detecting the closure of the arms.

The appliance may be designed such that the value of the variable is preserved when the appliance is switched off without the power supply to the appliance being cut.

Figure 2:
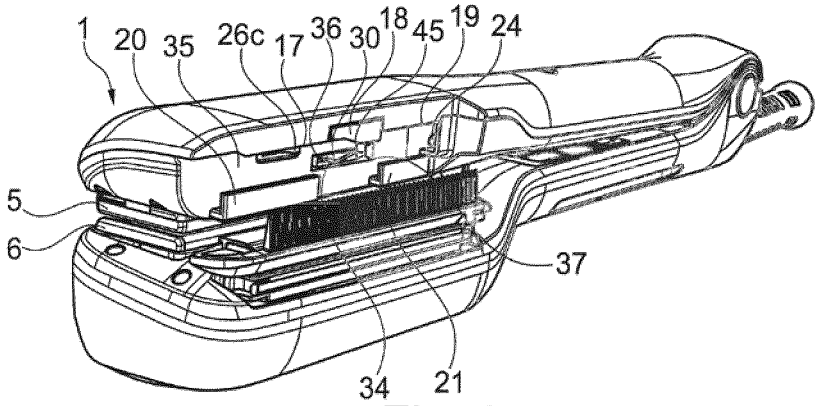
Figure 3:
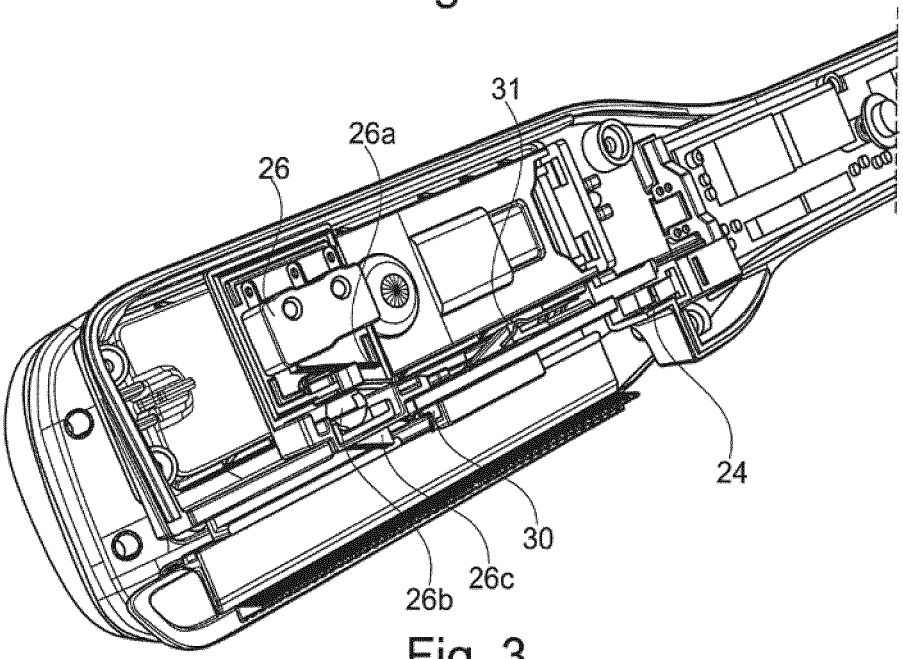
Figure 4:
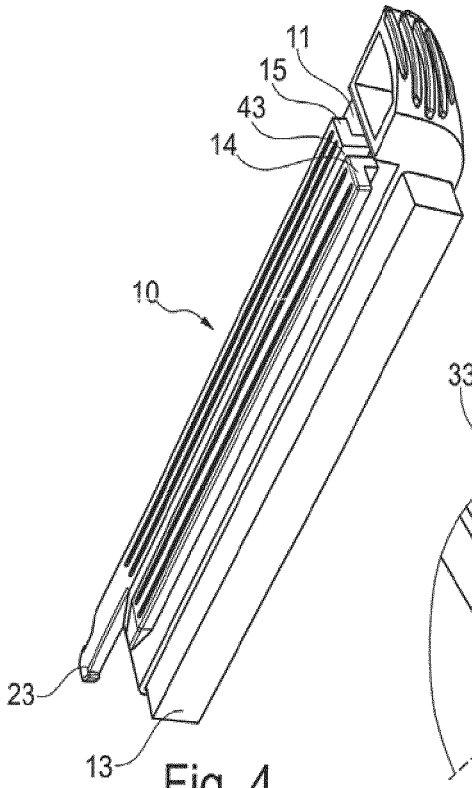
Figure 5A:
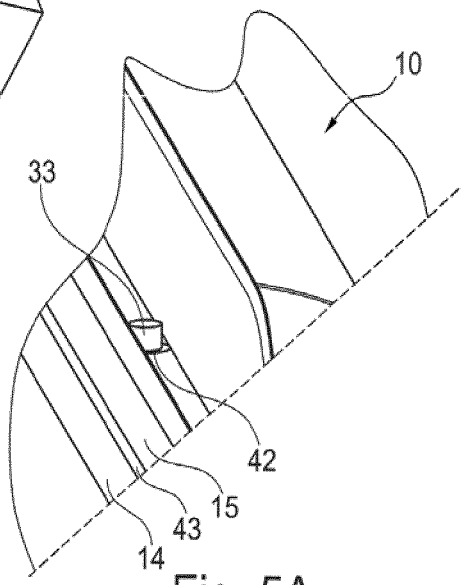
Figure 5B:
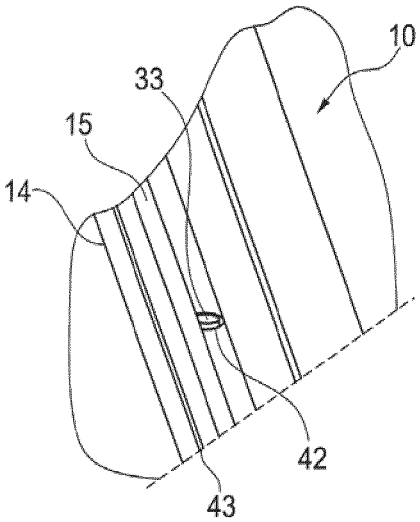
Figure 10:
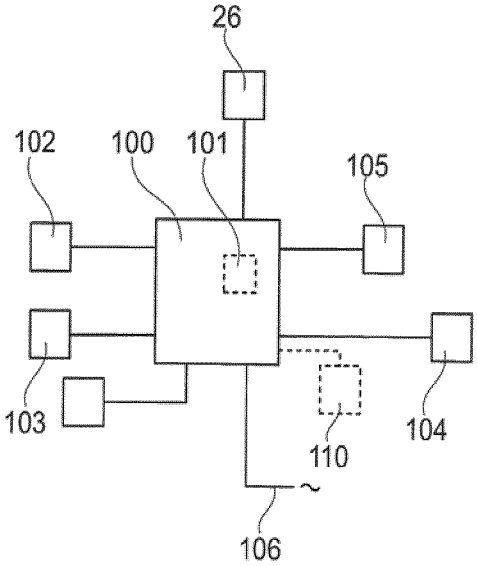
Figure 6A:
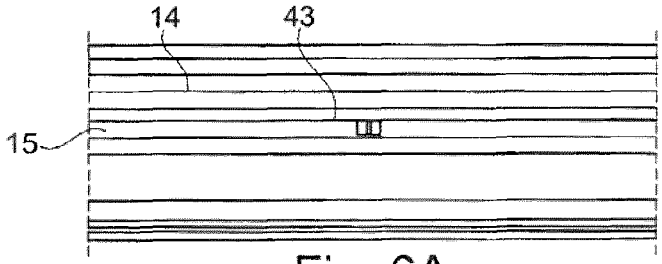
Figure 6B:
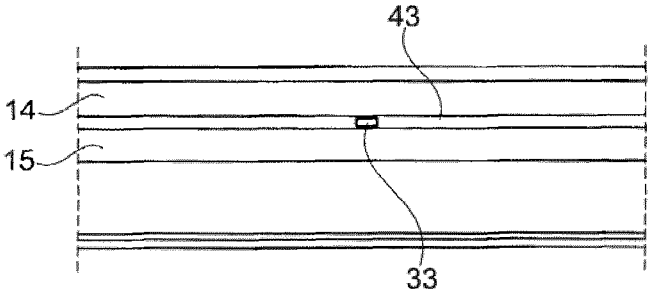
Figure 7:
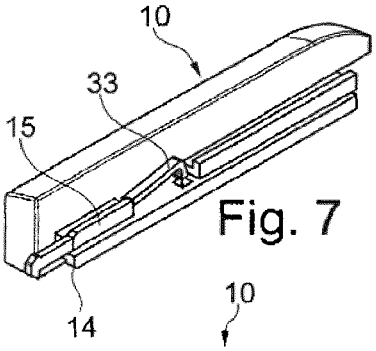
Figure 8:
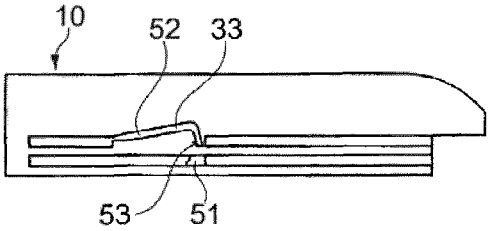
Figure 9A:
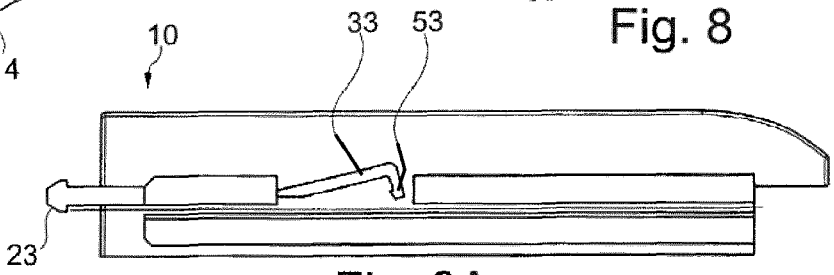
Figure 9B:
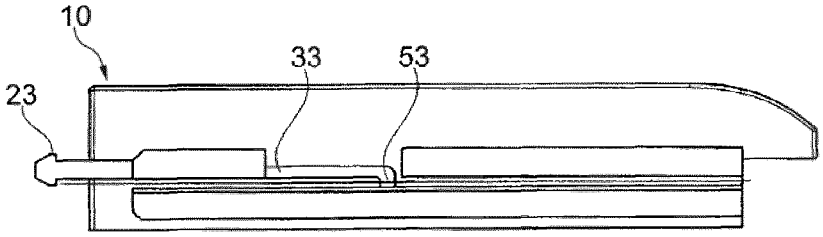
Figure 11:
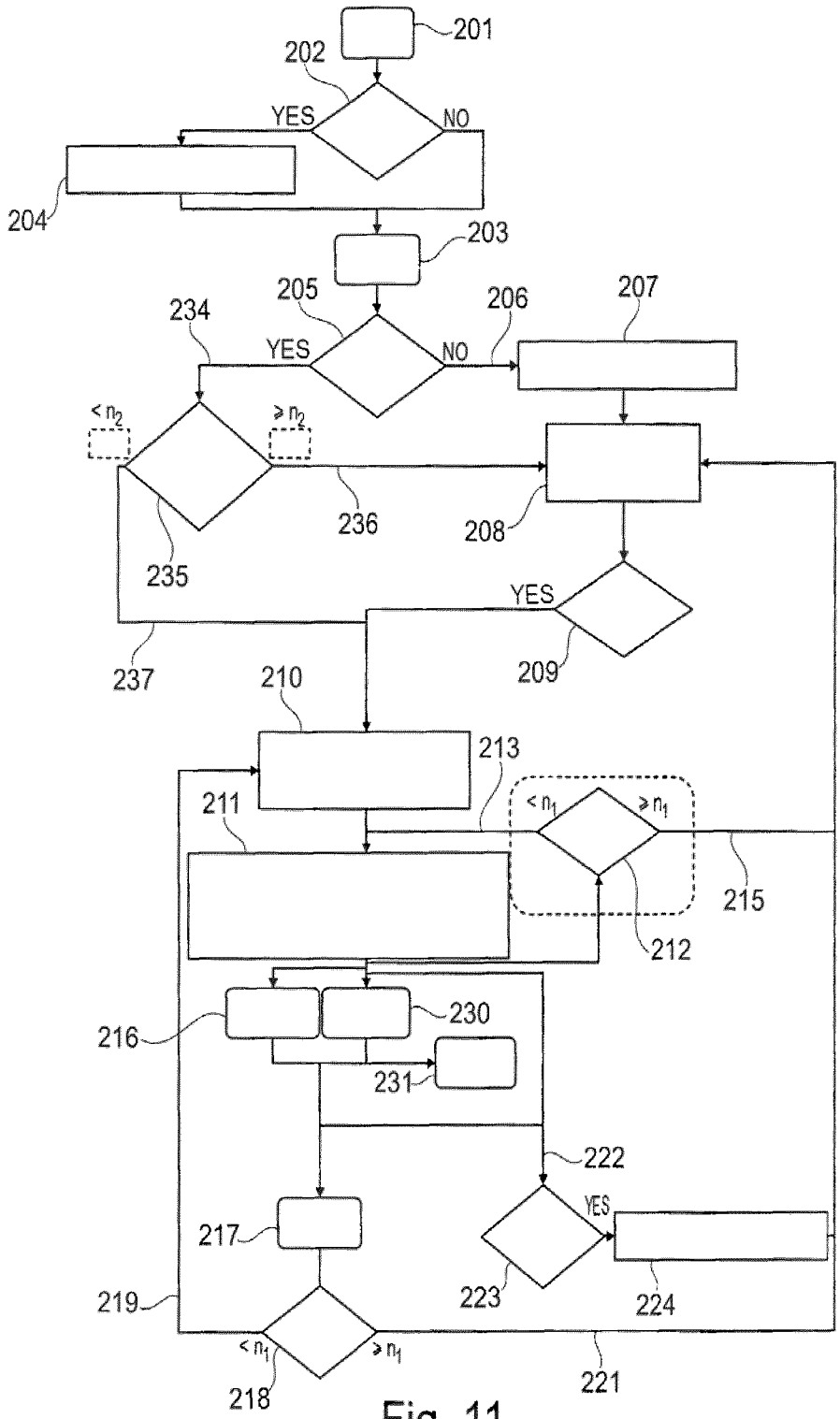
Figure 12:
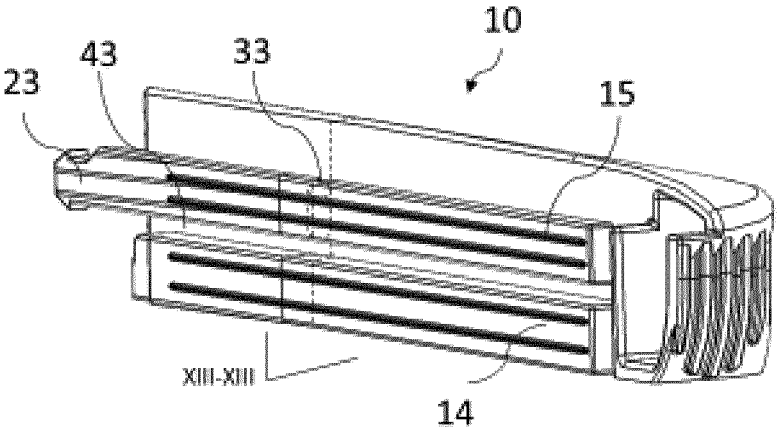
Figure 13:
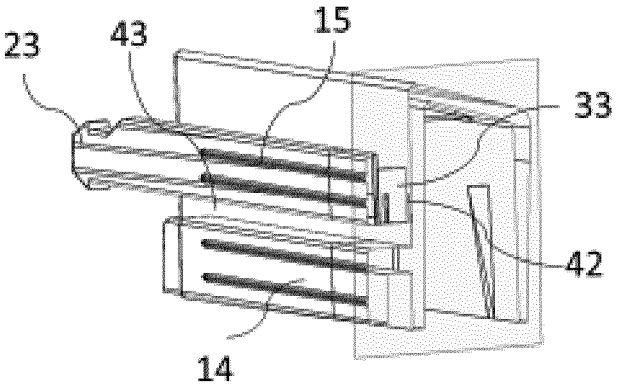
Figure 14:
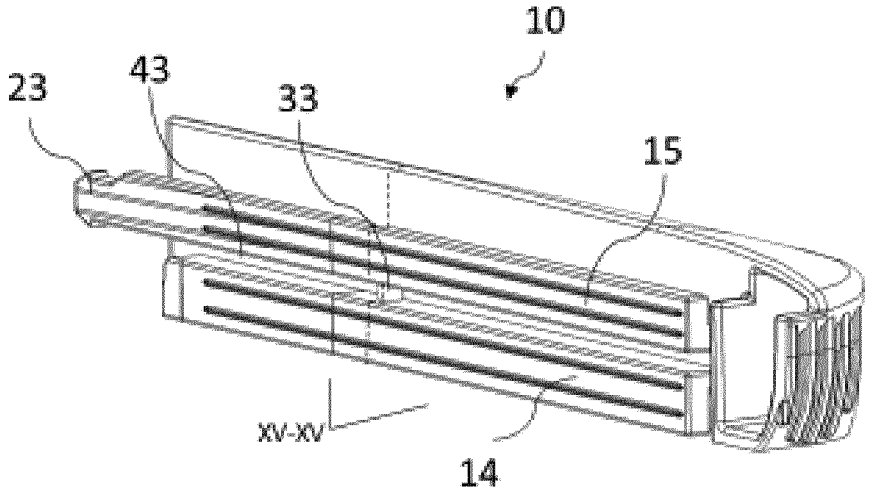
Figure 15:
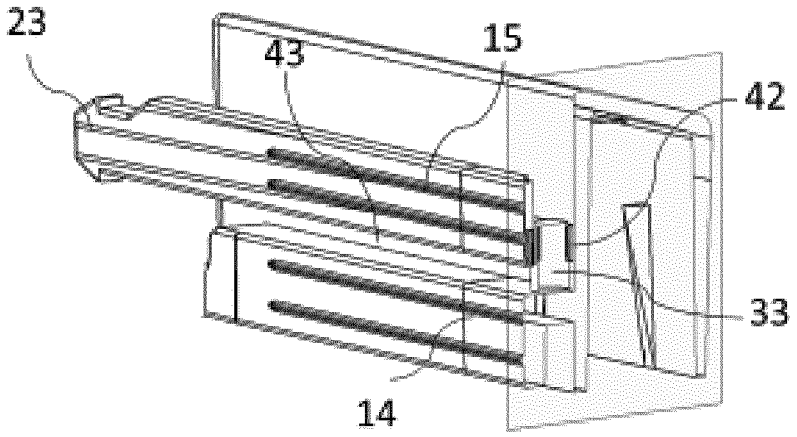

The invention may be better understood from reading the following detailed description of non-limiting exemplary embodiments thereof and from examining the appended drawing, in which:

FIG. 1 schematically shows a perspective view of an example of an appliance, with the refill fitted, FIG. 2 shows the appliance from FIG. 1 with the refill absent, FIG. 3 shows part of the appliance from FIG. 2, with the cover of the upper arm removed, FIG. 4 schematically shows a partial view of an example of a refill, FIG. 5A shows a detail of the refill, FIG. 5B is a view similar to FIG. 5A, after the refill has been used, FIGS. 6A and 6B show side views of the refill from FIG. 4, before and after use on the appliance, respectively, FIG. 7 schematically shows a perspective view of a variant refill according to the invention, FIG. 8 is a schematic longitudinal section through the refill in FIG. 7, FIGS. 9A and 9B illustrate the change in configuration of the refill from FIG. 8, before and after the use thereof, FIG. 10 is an example of an algorithm that can be implemented during the operation of the appliance, FIG. 11 shows, very schematically, the electronic circuit of the appliance, FIG. 12 schematically shows a perspective view of an example of a refill, FIG. 13 is a sectional view according to plane XIII-XIII of FIG. 12, FIG. 14 schematically shows a perspective view the refill of FIG. 12, after the refill has been used, and FIG. 15 is a sectional view according to plane XV-XV of FIG. 14.

In the example illustrated in the figures, the appliance 1 to which the invention applies is a straightening iron, having two arms 2, 3 that are connected by an articulation 4 and carry heating elements 5, 6 on opposing faces of the arms. These elements 5 and 6 make up straightening plates.

This appliance 1 takes a refill 10 which is fastened to one of the arms, next to one of the heating elements, in this case the upper arm 2 and the heating element 5.

The refill 10, shown on its own in FIG. 4, has a body 11 which contains a product to be applied, in this case a cosmetic product to be applied to the hair.

The refill 10 also has an application means 13 for applying this product, such as a felt, for example, which comes into contact with the hair while the appliance is being used. The refill 10 has a means 12 for fastening it to an accommodating structure of the appliance, only a part of which has been shown in FIG. 2.

The product contained in the refill can be applied to the hair as the latter passes between the arms.

In the example in question, the means for fastening the refill to the appliance has two profile elements 14 and 15, which are inserted into guide elements provided on the corresponding arm.

The appliance has for example three guide elements 17, 18 and 19 that are intended to cooperate with the upper profile element 15, and two guide elements 20 and 21 that are intended to cooperate with the lower profile element 14, when the refill 10 is fitted on the appliance.

The refill 10 may have, at the rear, a hook 23 that is intended to cooperate with a clip 24 in order to hold the refill in position, this hook 23 being snap-fastened in the clip 24 at the end of its insertion into the appliance, for example, and being able to be withdrawn therefrom by a mechanism of the push/pull type or the like.

The appliance has an electrical contactor 26 which is actuated by the refill 20 when the latter is present, and which makes it possible to indicate the presence of the refill. This contactor has a lever 26*a* against which a seal 26*b* may press, said seal itself being actuated by a pusher 26*c*.

The appliance 1 has a locking member 30, the role of which is to cooperate with an element 33 of the refill 10 that serves as a use memory.

The locking member 30 is returned elastically by a leaf spring 31 in this example and has, at the front, an edge 34 substantially perpendicular to the plane of the wall 35 to which the guide elements are attached, and, at the rear, a less steep edge 37.

The locking member 30 is disposed for example through a slot 36 in the wall 35 and can retract when the element 33 passes in the direction of removal of the refill.

In the example in question, the element 33 is in the form of a pin which is mounted with friction in a corresponding housing 42 in the upper profile element 15, as can be seen in FIGS. 5A, 12 and 13.

The element 33, the initial inactive configuration of which is shown in FIGS. 5A, 12 and 13, does not project into the space 43 defined between the two profile elements 14 and 15 before the refill is used for the first time, as can be seen in FIGS. 6 and 13, notably.

The appliance 1 has a relief designed to move the element 33 when the refill 10 is fitted on the appliance for the first time.

In the example in question, this relief is formed by a ramp 45 of the guide element 18 situated at the rear edge 37 of the locking member 30. Thus, when the profile elements 14 and 15 slide in the guide elements when the refill is used for the first time, the ramp 45 is pressed progressively against the element 33 and pushes it into its housing 42.

The element 33 thus projects into the space 43 between the profile elements 14 and 15, as illustrated in FIGS. 6B, 14 and 157.

The locking member 30 engages between the profile elements 14 and 15 when the refill 10 is fitted on the appliance. Thus, during the insertion of the refill 10, the locking member 30 sweeps over the zone into which the element 33 extends once in the active configuration as shown in FIGS. 5B, 14 and 15.

The slope of the rear edge 37 of the locking member 30 is chosen such that the element 33 can deform the locking member 30 during the removal of the refill in order to retract and pass over said locking member 30.

The pusher 26*c* which acts on the contactor 26 is situated upstream of the locking member 30 with regard to the direction of introduction of the refill 10 into the appliance 1.

Thus, the contactor 26 is actuated even before the locking member 30 exerts its possible action of blocking the insertion of the cartridge.

The assembly formed by the refill and the appliance operates as follows.

The first time the refill 10 is fitted on the appliance, the ramp 45 causes the element 33 to move from the configuration in FIGS. 5A, 12 and 13 to the one in FIGS. 5B, 14 and 15. This change in configuration takes place when the element 33 has already passed over the front edge 34 of the locking member 30, on account of the offset between this edge 34 and the ramp 45 in the direction of insertion of the refill 10. The locking member 30 therefore does not impair the fitting of the refill 10.

During the removal of the latter, the element 33 can pass over the locking member 30 on account of the slope of the rear edge 37 thereof.

However, if an attempt is made to refit the refill, the element 33 butts against the front edge 34 of the locking member 30 on account of the increased slope of this front edge 34, which prevents it from being passed over by the element 33. Therefore, the user cannot reuse the refill.

The element 33 that serves as a use memory can be embodied in various other ways and other than with the aid of a pin that is able to move with friction in a housing, as has just been described with reference to FIGS. 1 to 6B and 12 to 15.

It is thus possible, as illustrated in FIGS. 7 to 9B, to embody the element 33 in the form of a hook, having an end part 53 which catches in a housing 51 in the lower profile element 14 and a connecting part 52 which connects the end part 53 to the body of the refill. This embodiment makes it possible to form the element 33 by moulding it in one piece with the profile elements 14 and 15 and the body of the refill 10.

When the refill 10 is fitted for the first time, the ramp 45 of the appliance presses against the element 33, for example at the elbow formed between the parts 52 and 53 of the element 33, and the part 53 in order to be snap-fastened in the housing 51, as illustrated in FIG. 9B.

The path followed by the locking member 30 relative to the refill 10 while the latter is being fitted is shown by way of a broken line in this figure.

FIG. 9A shows that, in the initial configuration, which corresponds to the one in FIGS. 7 and 8, before the refill is used for the first time, the end part 53 is situated above the path of the locking member 30 and therefore does not impair the fitting of the refill. In the active configuration, as illustrated in FIG. 9B, once the end part 53 has been snap-fastened in the housing 51, it can butt against the locking element 30.

The appliance 1 has an electronic circuit 100, shown schematically in FIG. 10, which has an electronic memory 101, for example of the EEPROM type. This electronic circuit 100 is connected to the contactor 26 which is actuated while the refill 10 is being fitted on the appliance. It is also connected to at least one electrical resistor 102 for steam production, to one or more electrical resistors 103 for heating the elements 5, 6, and to one or more temperature sensors 104 that make it possible, for example, to know the temperature of the plates.

A switch 105, for example of the reed switch type, makes it possible to know the closed or open state of the appliance. The switch 105 is disposed for example on one of the arms and a magnet is disposed on the other of the arms so as to change the state of the switch 105 when the two arms 2, 3 are in the closed position. The switch 105 makes it possible to inform the electronic circuit 100 of the number of closures of the arms. The electronic circuit 100 is designed to be connected by a power cable 106 to the AC mains, for example the 110 V or 240 V mains.

The electronic circuit 100 may be in the form of one or more boards, some of which may be disposed in the handpiece and others of which may be disposed in the base station when the appliance has such a base station, which serves for steam production by containing for example a water reservoir and a pump.

The electronic circuit 100 has at least one component such as a microcontroller, programmed to execute an algorithm controlling the operation of the appliance, preferably in accordance with the diagram in FIG. 11.

The electronic circuit 100 is powered when the cable 106 is connected to the electric mains and can detect fitting of the refill when the appliance is switched off. The step 201 of connecting the cable 106 of the appliance to the mains makes it possible, in a step 202, to detect, by virtue of a contactor 26, the possible insertion of the refill 10 prior to the appliance 1 being switched on, in step 203, by pressing a corresponding button.

If the insertion of the refill is detected in step 202, then a variable ILS_nbr representative of the number of closures of the arms is initialized in step 204, even though the appliance 1 has not yet been started up.

When the appliance is switched on, in step 203, a detection of the presence of the refill is carried out in step 205. If the refill has not been fitted, which corresponds to the branch 206 in the diagram, the variable ILS_nbr is initialized in step 207 and the operation of the appliance 1 is effected in the downgraded mode, this being schematically indicated by the block 208 in FIG. 11. In this downgraded mode, the temperature is predefined so as to be non-adjustable, for example set to the value of 180° C., the generation of steam is prevented and cannot be activated, and the corresponding state is signalled to the user, for example by the flashing of an LED or the emission of an audible signal.

The appliance 1 remains in this downgraded mode until a refill is possibly inserted in step 209, in which case the appliance operates in a non-downgraded mode, depicted by the block 210 in FIG. 11, in which the temperature can be adjusted by the user, starting from a default value stored in the memory, which corresponds to the last use value in the non-downgraded mode. The steam generator is activated and the corresponding state signalled to the user for example by the abovementioned LED being illuminated in a non-flashing manner.

In the non-downgraded mode, the electronic circuit 100 detects the closure of the arms 2, 3 on the locks treated in step 211, so as to increment the variable ILS_nbr by a quantity representative of the number of closures. In order to save memory space, this variable is preferably incremented every n closures, where n=5, for example. Thus, every 5 closures, the variable ILS_nbr is incremented by 5 units.

In step 211, it is also possible to allow the user to modify the setpoint heating temperature of the plates. The quantity of water remaining for the generation of steam can be detected in order to trigger a corresponding alarm, if need be.

In step 212, a check is made as to whether the variable ILS_nbr is less than a predefined threshold n1, where n1=160, for example. If the variable ILS_nbr is less than n1, the cosmetic composition in the refill is considered not to have been used up and the appliance 1 can continue to operate in the non-downgraded mode, as is indicated schematically by the branch 213 in FIG. 11. If the value of the variable ILS_nbr becomes greater than or equal to the threshold n1, as is depicted by the branch 215, the appliance passes back into the downgraded mode, corresponding to the block 208 in FIG. 11. The setpoint heating temperature of the plates thus returns to the predefined value of the downgraded mode, the operation of the steam generator is interrupted, and the corresponding state is signalled by the display of the LED, which flashes.

If the appliance 1 is stopped without its power supply being cut, this being shown schematically in step 216, and the appliance is then started in step 217, the stored value of the variable ILS_nbr is read in step 218. If this value is less than the threshold n1, as is depicted by the branch 219 in FIG. 10, the appliance maintains the non-downgraded mode depicted by the block 210. If the stored value of the variable ILS_nbr is greater than or equal to the threshold n1, the appliance passes into the downgraded mode, as is depicted by the branch 221 and the block 208.

If, when the appliance is on, the user removes the refill, as is depicted by the branch 220 and step 223, the variable ILS_nbr is reinitialized in step 224 and the appliance 1 passes into the downgraded mode.

Preferably, the appliance 1 is designed, in the event of a prolonged period of non-use, that is to say without closures of the arms 2, 3 being detected, to pass into sleep mode in step 230, until the on button is pressed in step 210.

The block 231 schematically indicates the case in which the appliance 1 is disconnected, in which case, when it is reconnected, the algorithm in FIG. 10 returns to step 201 described above.

Returning to the test in step 205, if the appliance 1 is started in step 203 with the refill 10 already fitted, this corresponding to the branch 234 in FIG. 10, the value of the variable ILS_nbr is read in step 235 and this value is compared with a second threshold n2, which is different from the threshold n1 and notably less than the latter. The threshold n2 is equal to 20, for example. If the value of the variable ILS_nbr is greater than or equal to n2, the appliance passes into the downgraded mode in step 208. This thus avoids operating the device in the non-downgraded mode if the user has disconnected and then reconnected the appliance with an already significant number of openings and closures of the arms, it being probable that the user has started to use the refill and has then allowed a non-negligible period of time to pass before resuming treatment, since disconnecting the appliance frequently implies that it has been stowed away. In the case of uses that are excessively spaced apart in time, the cosmetic composition contained in the refill is likely to evaporate, resulting in reduced effectiveness of the refill.

If the variable ILS_nbr is strictly less than the second threshold n2, the appliance can operate in the non-downgraded mode, corresponding to the branch 237 and the block 210 in FIG. 11.

The invention is not limited to the algorithm illustrated.

It may notably be advantageous to count not just the number of closures of the arms but also the duration of closure of the arms on the hair, which may be representative of the length of locks treated. This can make it possible to determine more exactly the degree to which the cosmetic composition within the refill has been used up and thus to signal the need to replace the refill more precisely to the user.

In order to determine the duration of closure of the arms, the electronic circuit 100 of the appliance is advantageously provided with a clock 110, shown by way of dotted lines in FIG. 10, preferably provided with a battery for saving the data in a clock memory.

In the example in question, the downgraded mode corresponds to operation without the steam generator at a predefined temperature of the heated plates.

In variant embodiments of the invention, the downgraded mode is different and corresponds for example to operation still with a possibility of adjusting the temperature of the heated plates, this preferably being more limited than in the presence of steam.

In a variant that is not illustrated, the appliance is designed such that it can identify the nature of the fitted refill, by virtue for example of one or more reliefs on the refill which encode information which is read by one or more corresponding contactors present on the appliance. In this case, it is possible to modify the threshold values, notably the first threshold n1, depending on the nature of the refill, for example in order to take into account the fact that the cosmetic composition is used up differently from one refill to another depending on the nature thereof.

It is also possible, in one variant, to store the duration for which a refill is present on the corresponding arm. This can notably make it possible to force the appliance to pass into the downgraded mode beyond a certain duration in order to avoid a situation in which the user carries out a treatment with a refill, the cosmetic composition of which may have lost its effectiveness on account of its evaporating, for example.

Needless to say, the invention is not limited to the examples that have just been described.

The element 33 is produced for example by being moulded together with the adjacent profile element, being connected thereto by one or more severable bridges of material. Once in the active configuration, the element 33 can be held only by friction or, alternatively, by snap-fastening in the opposite profile element.

Although the invention has been illustrated in connection with a refill fitted on the appliance by a sliding movement, the invention also applies to refills that are fitted by a movement other than just a sliding movement, for example a rotational movement or a more complex movement including translational and rotational components, for example.

The contactor 26 which detects the fitting of the refill can be situated elsewhere on the arm, notably be present within the mechanism of the push/pull type which cooperates with the hook 23.

The contactor 26 can also be situated under the pressing element against which the application means 13 presses when the arms are closed.

The locking member 30 can also be produced as a plastics part that is articulated about a pivot axis and is returned to its initial position by a coil spring.

The shape of the profile of the cartridge may be different from the overall T shape illustrated, and the element 33 can be moved in some other way than in the spatial direction defined between the two profile elements; for example, it can be moved in a direction parallel to the stem of the T.

If need be, the presence of the element 33 in the active configuration, that is to say after the cartridge has already been used, can be detected automatically if an attempt is made to fit the cartridge on the appliance, by virtue for example of a mechanical or optical sensor, in order to signal the reason for which the refill cannot be fitted to the user, for example by a message being displayed on a screen or by an indicator light being illuminated.

The invention claimed is:

1. An appliance for treating the hair, comprising:

two arms to be closed over the hair to be treated, at least one of the arms carrying a refill containing a hair treatment product to be applied to the hair;

an electronic control circuit comprising an electronic memory, the electronic control circuit being designed to detect a closure of the arms and a fitting of the refill on the appliance;

a steam generator for outputting steam from a liquid water reservoir of the device onto the hair; and at least one heated straightening plate, the electronic control circuit being designed, when the electronic control circuit detects the fitting of a refill on the appliance, to store and increment in the electronic memory a variable representing at least a number of the closure of the arms detected by the electronic control circuit and, when said variable exceeds a first predefined threshold, to move the appliance into a downgraded mode of operation, the operation of the steam generator being interrupted and/or the temperature of the straightening plate being modified in the downgraded mode of operation.

2. The appliance according to claim 1, wherein the temperature adjustment range of the straightening plate is reduced in the downgraded mode compared with operation in a non-downgraded mode.

3. The appliance according to claim 1, wherein the variable incorporates a time for which the arms are closed over the hair.

4. The appliance according to claim 1, wherein said variable is reset when the refill is changed.

5. The appliance according to claim 1, which is designed to pass into the downgraded mode when said variable exceeds a second predefined threshold, different from the first predefined threshold over several uses between which a power supply to the appliance is disconnected.

6. The appliance according to claim 1 further comprising a contactor actuated by the refill fitted on the arm.

7. The appliance according to claim 1, wherein the refill includes a porous substrate impregnated with a cosmetic composition.

8. The appliance according to claim 1 further comprising a contactor carried by one of the arms between a head of the arms and an articulation.

9. The appliance according to claim 1, wherein a value of the variable is preserved when the appliance is switched off without disconnection of a power source to the appliance.

10. The appliance according to claim 1, further comprising a locking member configured to cooperate with an element of the refill to mechanically prevent the fitting of the refill that has previously been used and then removed.

* * * * *